US007596949B2

(12) United States Patent
DeVane et al.

(10) Patent No.: US 7,596,949 B2
(45) Date of Patent: Oct. 6, 2009

(54) METHOD AND APPARATUS FOR HEAT SHIELDING GAS TURBINE ENGINES

(75) Inventors: Shaun Michael DeVane, Cincinnati, OH (US); Erika Suzanne Show, Cincinnati, OH (US); Glenn Edward Wiehe, Cincinnati, OH (US); Timothy Glen Umbaugh, Maineville, OH (US); James Neil Cooper, Hamilton, OH (US); Mateusz Pawel Wenclik, Niewodnica Koscielna (PL); Marek Krzysztof Krol, Warsaw (PL)

(73) Assignee: General Electric Company, Schenectady, NY (US)

( * ) Notice: Subject to any disclaimer, the term of this patent is extended or adjusted under 35 U.S.C. 154(b) by 646 days.

(21) Appl. No.: 11/360,205

(22) Filed: Feb. 23, 2006

(65) Prior Publication Data

US 2007/0193273 A1 Aug. 23, 2007

(51) Int. Cl.
*F02C 7/00* (2006.01)

(52) U.S. Cl. ..... 60/748; 60/798

(58) Field of Classification Search ..... 60/752, 60/796–800, 748, 804
See application file for complete search history.

(56) References Cited

U.S. PATENT DOCUMENTS 5,419,115 A * 5/1995 Butler et al. ..... 60/804
5,623,827 A 4/1997 Monty
5,630,319 A * 5/1997 Schilling et al. ..... 60/747
5,664,412 A 9/1997 Overton
5,894,732 A 4/1999 Kwan
6,141,967 A 11/2000 Angel et al.
6,164,055 A 12/2000 Lovett et al.
6,298,667 B1 10/2001 Glynn et al.
6,311,928 B1 * 11/2001 Presz et al. ..... 244/110 B
6,314,739 B1 * 11/2001 Howell et al. ..... 60/748
6,389,815 B1 5/2002 Hura et al.
6,418,726 B1 7/2002 Foust et al.
6,530,223 B1 3/2003 Dodds et al.
6,581,386 B2 * 6/2003 Young et al. ..... 60/748
6,871,501 B2 3/2005 Bibler et al.

* cited by examiner

*Primary Examiner*—Michael Cuff
*Assistant Examiner*—Phutthiwat Wongwian
(74) *Attorney, Agent, or Firm*—William Scott Andes, Esq.; Armstrong Teasdale LLP

(57) ABSTRACT

A method for fabricating a gas turbine engine combustor that includes a domeplate and at least one fuel injector extending through an opening in the domeplate. The method includes fabricating a heatshield that includes a threaded collar extending upstream from the heatshield, positioning the heatshield on a downstream side of the domeplate such that the threaded collar is received within the domeplate opening, and coupling a retainer to the collar on an upstream side of the domeplate such that the domeplate is securely coupled between the heat shield and the retainer.

14 Claims, 5 Drawing Sheets

METHOD AND APPARATUS FOR HEAT SHIELDING GAS TURBINE ENGINES

BACKGROUND OF THE INVENTION

This application relates generally to gas turbine engines, and more particularly, to a heat shield assembly utilized within a gas turbine engine.

At least one known gas turbine engine includes a combustor that includes between ten and thirty mixers to facilitate mixing relatively high velocity air with liquid fuels, such as diesel fuel, or gaseous fuels, such as natural gas. These mixers usually include a single fuel injector located at a center of a swirler for swirling the incoming air to enhance flame stabilization and mixing. Both the fuel injector and mixer are located on a combustor dome.

The combustor also includes a heat shield that facilitates protecting the dome assembly. The heat shields are cooled by impinging air on the side nearest the dome to ensure that the operating temperature of the heat shields remains within predetermined limits. However, since known heat shields have a limited useful life, it is often relatively difficult to remove the used heat shield to install a new heat shield, and as such, may adversely impact the maintenance procedure.

BRIEF DESCRIPTION OF THE INVENTION

In one aspect, a method for fabricating a gas turbine engine combustor that includes a domeplate and at least one fuel injector extending through an opening in the domeplate is provided. The method includes fabricating a heatshield that includes a threaded collar extending upstream from the heatshield, positioning the heatshield on a downstream side of the domeplate such that the threaded collar is received within the domeplate opening, and coupling a retainer to the collar on an upstream side of the domeplate such that the domeplate is securely coupled between the heat shield and the retainer.

In another aspect, a heat shield assembly for a gas turbine engine combustor is provided. The heat shield assembly includes a heat shield coupled against a downstream side of the domeplate; a threaded collar extending upstream from the heatshield, the threaded collar received within the domeplate opening; and a retainer coupled to the collar such that the domeplate is securely coupled between the heat shield and the retainer.

In a further aspect, a gas turbine engine combustor is provided. The gas turbine engine combustor includes an inner liner and an outer liner, and a domeplate coupled to at least one of the inner and outer liners, the domeplate including a downstream side, an upstream side, and at least one opening extending therethrough for discharging cooling fluid therefrom for impingement cooling at least a portion of a heat shield assembly. The heat shield assembly includes a heat shield coupled against the domeplate downstream side, a threaded collar extending upstream from the heatshield, the threaded collar received within the domeplate opening, and a retainer coupled to the collar such that the domeplate is securely coupled between the heat shield and the retainer.

DETAILED DESCRIPTION OF THE INVENTION

Figure 1:
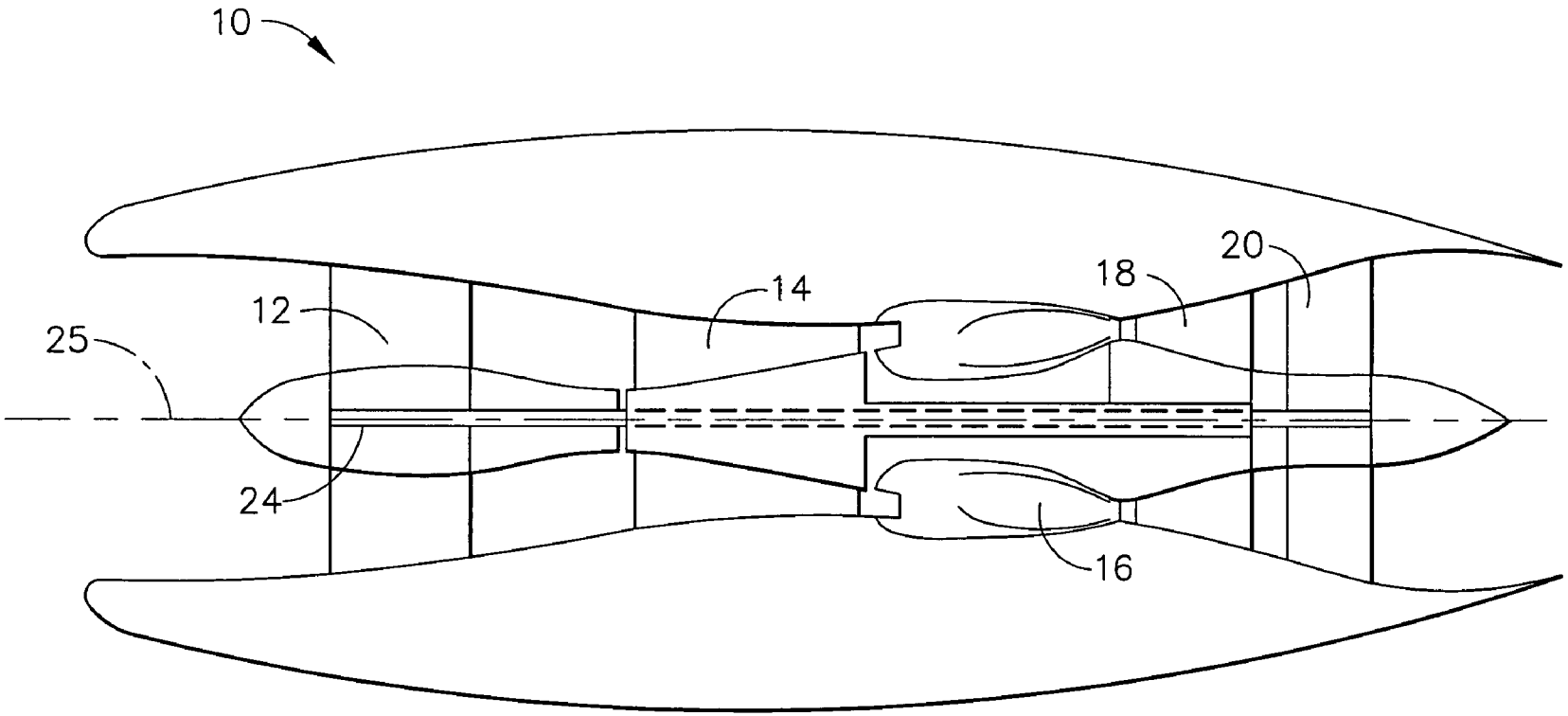
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20. In one embodiment, gas turbine engine 10 is a CFM engine available from CFM International. In another embodiment, gas turbine engine 10 is an LM6000 DLE engine available from General Electric Company, Cincinnati, Ohio.

Figure 2:
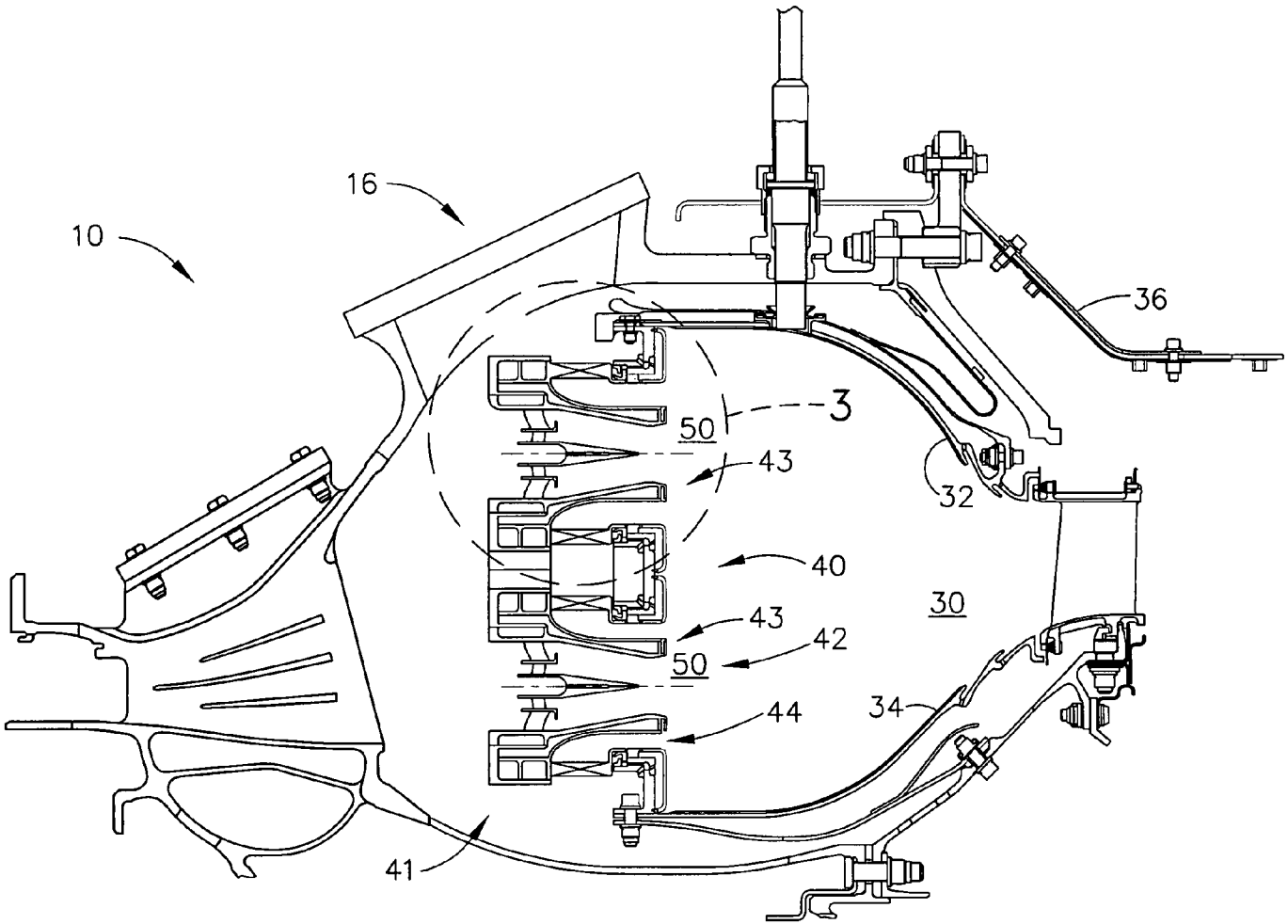
FIG. 2 is a cross-sectional view of an exemplary combustor that may be used with the gas turbine engine shown in FIG. 1.
Figure 3:
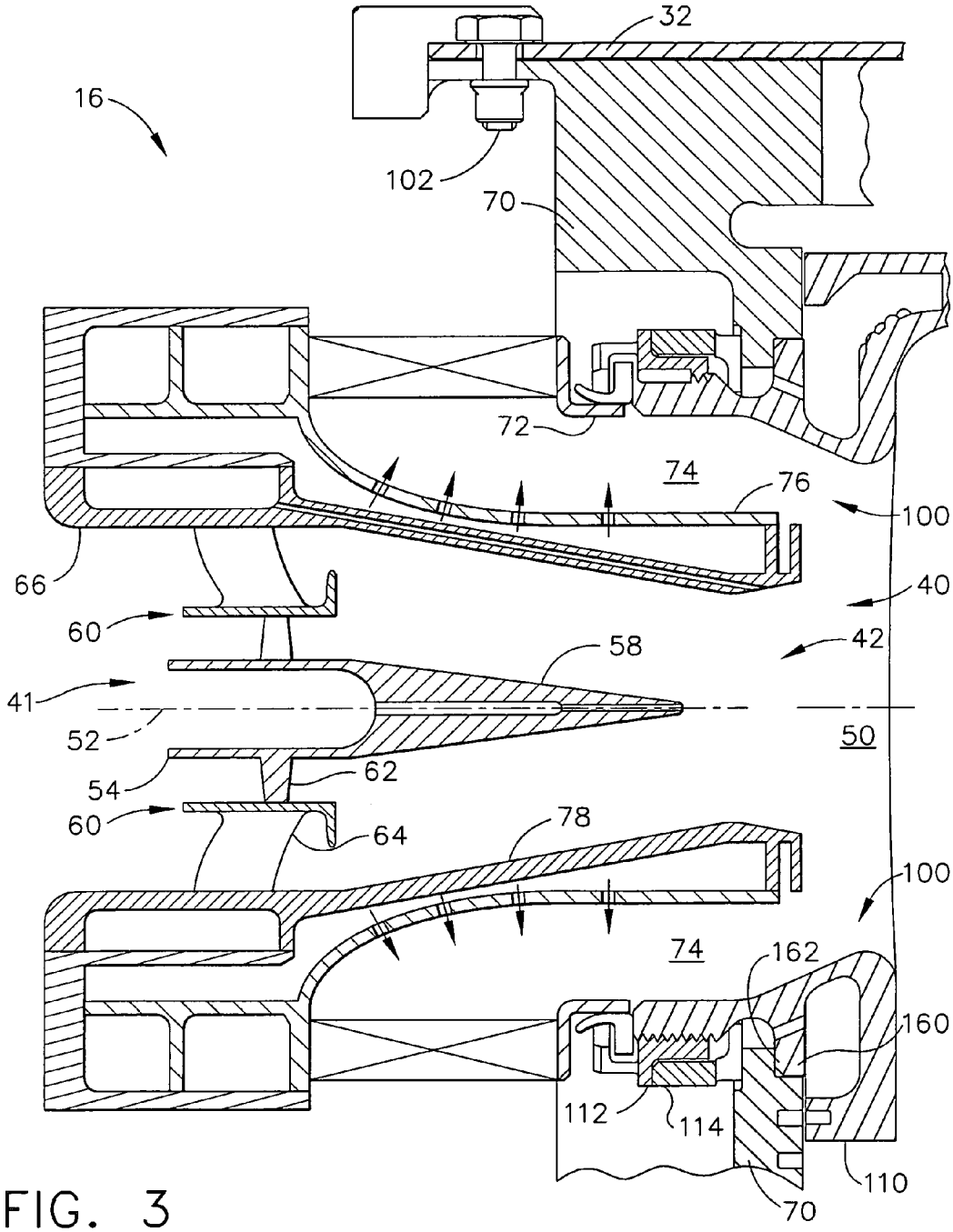
FIG. 3 is an enlarged view of a portion of the combustor shown in FIG. 2 taken along area 3.

FIG. 2 is a cross-sectional view of exemplary combustor 16, shown in FIG. 1, and FIG. 3 is an enlarged partial view of combustor 16 taken along area 3. Combustor 16 includes a combustion zone or chamber 30 defined by annular, radially outer and radially inner liners 32 and 34. More specifically, outer liner 32 defines an outer boundary of combustion chamber 30, and inner liner 34 defines an inner boundary of combustion chamber 30. Liners 32 and 34 are radially inward from an annular combustor casing 36, which extends circumferentially around liners 32 and 34.

Combustor 16 also includes a plurality of annular domes 40 mounted upstream from outer and inner liners 32 and 34, respectively. Domes 40 define an upstream end of combustion chamber 30. At least two mixer assemblies 41 are spaced circumferentially around domes 40 to deliver a mixture of fuel and air to combustion chamber 30. Because combustor 16 includes two annular domes 40, combustor 16 is known as a dual annular combustor (DAC). Alternatively, combustor 16 may be a single annular combustor (SAC) or a triple annular combustor.

Each mixer assembly 41 includes a pilot mixer 42, a main mixer 44, and an annular centerbody 43 extending therebetween. Centerbody 43 defines a chamber 50 that is in flow communication with, and downstream from, pilot mixer 42. Chamber 50 has an axis of symmetry 52, and is generally cylindrical-shaped. A pilot centerbody 54 extends into chamber 50 and is mounted symmetrically with respect to axis of symmetry 52. In one embodiment, centerbody 54 includes a fuel injector 58 for dispensing droplets of fuel into pilot chamber 50.

Pilot mixer 42 also includes a pair of concentrically mounted swirlers 60. More specifically, in the exemplary embodiment, swirlers 60 are axial swirlers and include an integrally-formed pilot inner swirler 62 and a pilot outer swirler 64. Alternatively, inner swirler 62 and outer swirler 64 are separate components. Pilot inner swirler 62 is annular and is circumferentially disposed around centerbody 54. Pilot outer swirler 64 is circumferentially disposed between pilot inner swirler 62 and a radially inner surface 66 of centerbody 43. Each swirler 62 and 64 includes a plurality of vanes (not shown). Injection orifices (not shown) for gaseous fuels are located near the trailing edge of pilot outer swirler vanes 64, and in a surface 66 extending adjacent pilot outer swirler vanes 64. Swirlers 62 and 64, and the location of the injection orifices are selected to provide desired ignition characteristics, lean stability, and low carbon monoxide (CO) and hydrocarbon (TIC) emissions during low engine power operations.

In one embodiment, a pilot splitter (not shown) is positioned radially between pilot inner swirler 62 and pilot outer swirler 64, and extends downstream from pilot inner swirler 62 and pilot outer swirler 64.

In one embodiment, pilot swirler 62 swirls air flowing therethrough in the same direction as air flowing through pilot swirler 64. In another embodiment, pilot inner swirler 62 swirls air flowing therethrough in a first direction that is opposite a second direction that pilot outer swirler 64 swirls air flowing therethrough.

Main mixer 44 includes an outer throat surface 81, that in combination with a radially outer surface 76 of centerbody 43, defines an annular premixer cavity 74. Main mixer 44 is concentrically aligned with respect to pilot mixer 42 and extends circumferentially around pilot mixer 42.

Combustor 16 also includes a domeplate 70 and a heat shield assembly 100 that is coupled to domeplate 70. More specifically, domeplate 70 includes at least one opening 80 extending therethrough that is sized to receive at least a portion of heat shield assembly 100. In the exemplary embodiment, domeplate 70 is coupled to outer liner 32 and combustor casing 36 utilizing a plurality of fasteners 102. Heat shield assembly 100 includes at least a heat shield 110 that is removably coupled to domeplate 70 via a retainer 112 and a spacer 114 such that fluids discharged from premixer cavity 74 are directed downstream and radially inwardly.

Figure 4:
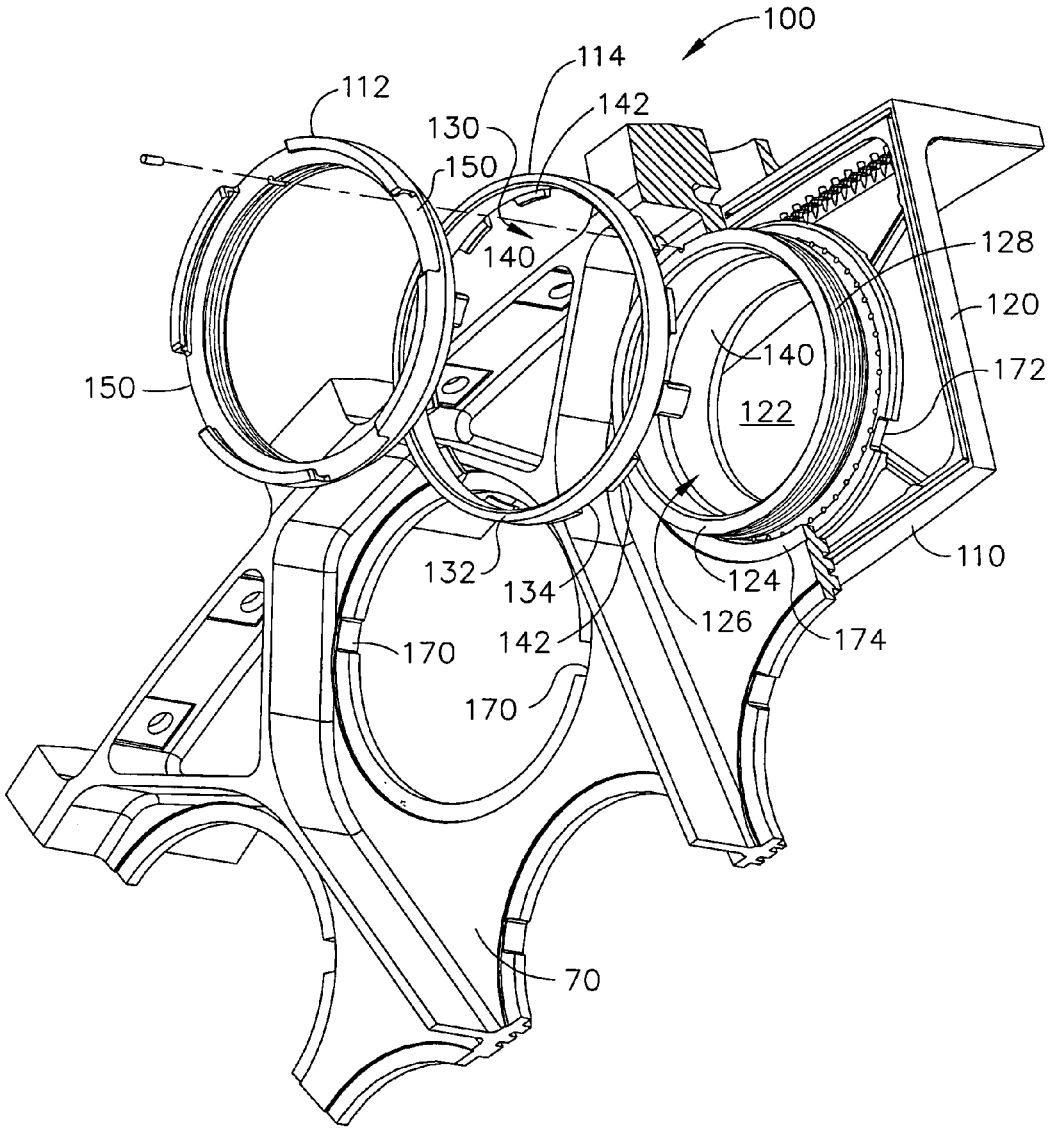
FIG. 4 is an exploded view of the heat shield assembly shown in FIG. 3.
Figure 5:
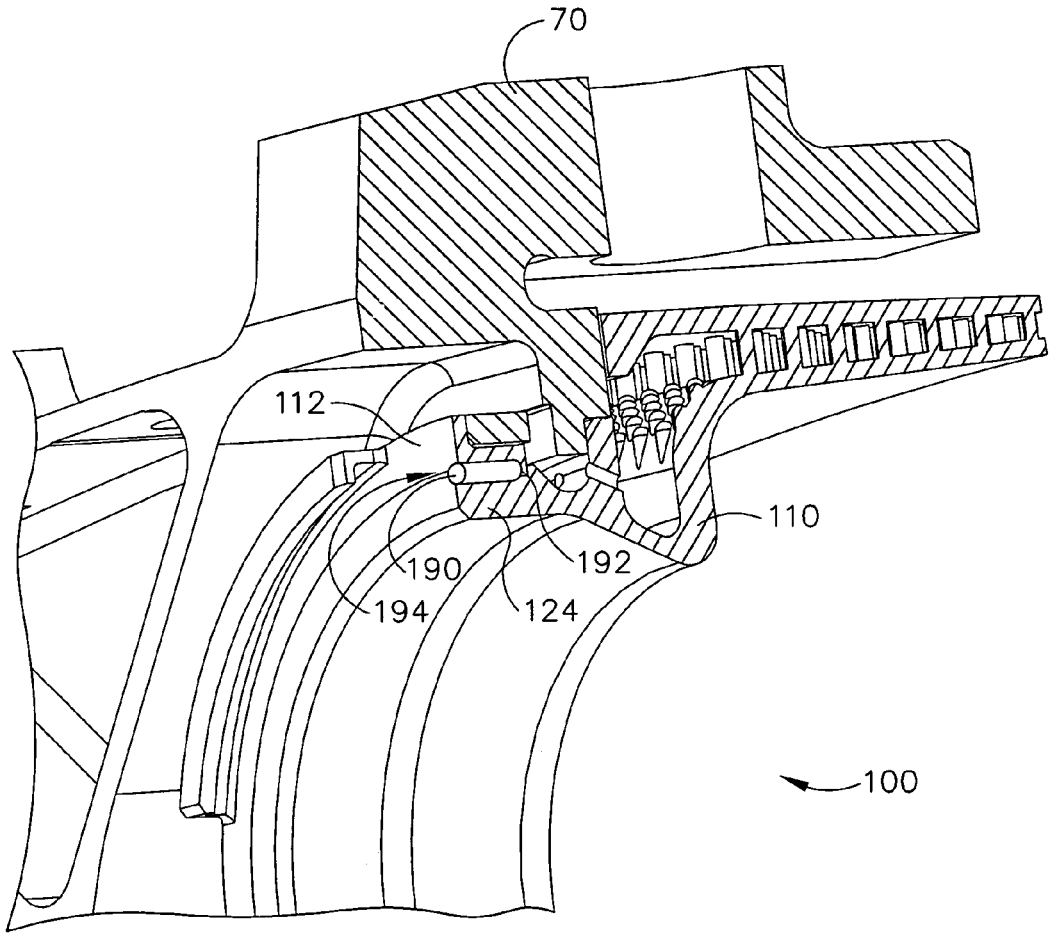
FIG. 5 is a perspective view of a portion of the heat shield assembly shown in FIG. 3.

FIG. 4 is an exploded view of heat shield assembly 100 shown in FIG. 3, and FIG. 5 is a partial perspective view of a portion of heat shield assembly 100 shown in FIGS. 3 and 4. In the exemplary embodiment, heat shield 110 includes a heat shield portion 120 that has a first opening 122 extending therethrough and a threaded collar 124 that is substantially cylindrical shaped that has a second opening 126 extending therethrough. In the exemplary embodiment, first opening 122 has a diameter that is substantially similar to a diameter of second opening 126. During fabrication, heat shield portion 120 is coupled to threaded collar 124 such that first and second openings 122 and 126, respectively, are substantially axially aligned. In one embodiment, heat shield portion 120 and threaded collar 124 are formed as a unitary heat shield 110. Optionally, heat shield portion 120 is attached to threaded collar 124 utilizing a welding or brazing procedure, for example. Threaded collar 124 includes a plurality of threads 128 that are machined into an exterior surface of threaded collar 124 such that retainer 112 may be coupled to threaded collar 124.

In the exemplary embodiment, spacer 114 is substantially cylindrical in shape and has an opening 130 extending therethrough. Opening 130 is sized such that spacer 114 may be positioned about heat shield threaded collar 124. More specifically, spacer 114 is sized to circumscribe heat shield threaded collar 124. Spacer 114 includes a first end 132, an opposite second end 134, and a plurality of tabs 136 extending from second end 134. More specifically, spacer 114 includes a first plurality of tabs 140, also referred to herein as anti-rotation tabs, that are coupled to and extend axially aft from second end 134 and a second plurality of tabs 142 that are coupled to and extend radially inwardly from second end 134. In the exemplary embodiment, tabs 140 and 142 facilitate maintaining spacer 114 and heat shield 110 is a substantially fixed position with respect to domeplate 70 as will be discussed later herein.

In one embodiment, retainer 112 is a retaining nut that includes a plurality of internal threads that are utilized to couple retainer 112 to heat shield 110. In the exemplary embodiment, retainer 112 is a castellated nut, that is it includes a series of castellated slots 150 that extend substantially circumferentially around an exterior surface of retainer 112 to facilitate coupling or removing retainer 112 to heat shield 110.

During assembly, heat shield 110 is coupled to domeplate 70 utilizing both retainer 112 and spacer 114. Specifically, heat shield threaded collar 124 is inserted at least partially through domeplate opening 122 until a shoulder 160 formed in heat shield 110 is at least partially seated into a slot 162 formed in heat shield 110. In the exemplary embodiment, shoulder 160 and slot 162 cooperate to maintain heat shield 110 in a substantially fixed radial position. As shown in FIGS. 3, 4, 5, when heat shield shoulder 160 is positioned within domeplate slot 162, at least a portion of the heat shield 110 extends through the opening 112 formed through domeplate 70. More specifically, at least a portion of the threaded portion of the heat shield, i.e. threaded collar 124 extends through the domeplate 70 to facilitate coupling retainer 114 to heat shield 110, and thus coupling heat shield 110 to domeplate 70 which is discussed below.

After the heat shield threaded collar 124 is inserted at least partially through domeplate opening 122, spacer 114 is positioned about threaded portion 124 such that that the first plurality of tabs 140 each extend through a respective slot 170 formed through domeplate 70 and seat within a respective slot 172 formed within heat shield 110. As such, tabs 140 facilitate maintaining spacer 114 in a relatively fixed radial position with respect to domeplate 70 and heat shield 110, and also facilitate maintaining heat shield 110 is a relatively fixed radial position with respect to domeplate 70. Moreover, spacer 114 is positioned about threaded portion 124 such that that the second plurality of tabs 142, which are formed substantially normal or perpendicular to first plurality of tabs 140 facilitate maintaining spacer 114 is a relatively fixed axial position. More specifically, spacer 114 is positioned about threaded portion 124 such that the second plurality of tabs 142 are seated within a groove 174 that is formed within domeplate 170.

To secure heat shield 110 and spacer 114 to domeplate 70, retainer 112 is threaded to heat shield threaded collar 124. Since spacer 114 has a diameter that is greater than a diameter of groove 174, as retainer 112 is tightened, spacer tabs 142 will seat within groove 174 and thus allow heat shield 110 to be secured to domeplate 70. As such, spacer device 114 facilitates maintaining heat shield 110 in a substantially fixed position with respect to domeplate 70 when retainer 112 is either being installed or removed.

In the exemplary embodiment, heat shield assembly 100 also includes a pin 190 that is inserted through an opening 192 formed through retainer 112 and heat shield threaded collar 124. More specifically, at least one opening 192 is defined at least partially through the threaded interface 194 between heat shield 110 and retainer 112. Pin 190 is then inserted at least partially within opening 190 to facilitate securing retainer 112 in a substantially fixed radially position with respect to heat shield 110. More specifically, pin 190 facilitates ensuring that retainer 112 does not loosen during engine operation and thus cause heat shield 110 to move within combustor 16. Optionally, an anti-sieze compound or tape is applied to the threaded portion of heat shield 110 to facilitate removing or installing retainer 112.

The heat shield assembly described herein may be utilized on a wide variety of gas turbine engines such as LM6000 and LM2500 DLE manufactured by General Electric combustors have life-limited heatshields. The heat shield assembly includes a heat shield having an externally threaded collar coupled to the heat shield. The threaded collar is sized to be inserted through an opening defined through the domeplate.

A spacer is then positioned over the threaded collar, and a threaded nut is screwed on to the heatshield collar. More specifically, the spacer includes at least two legs, referred to herein as anti-rotation tabs, that extend through the domeplate and engage the heatshield. These legs position the heatshield and also facilitate preventing the heatshield from spinning while a torque is being applied to the threads. As such, the spacer, including the anti-rotation tabs provide a stronger reaction surface to counteract the assembly and disassembly torque, as well as act to protect the domeplate from damage resulting from the reaction.

The threaded nut facilitates clamping the domeplate between the heatshield and nut thus retaining the heatshield in place. To prevent the threaded nut from backing off of the threaded retainer during engine operation, a locking pin is inserted between the threads of the heatshield and the threads of the retainer. More specifically, the heatshield threaded collar is inserted through the domeplate, the threaded retainer is coupled to the collar and tightened or torqued to its final assembly torque value. The assembly including substantially all the combustor heat shields utilized within the gas turbine engine is then placed on a mill for example, and an opening is formed through the threaded interface between the collar and the retainer. A pin is then inserted at least partially within the opening, and a weld bead is applied to ensure that the pin is maintained within the opening during engine operation. As such, the pin provides a mechanical locking feature for the threads that is not dependent on tack welding of an external bracket that is subject to liberation during engine operation.

Accordingly, the heat shield assembly described herein provides a threaded pin that has an increased break torque during disassembly and also provides at least forty-five foot pounds of running torque to facilitate preventing the heatshield from moving during engine operations. Moreover, the spacer facilitates positioning the heatshield with respect to the domeplate since the anti-rotation tabs provide positional control and also provides adequate heatshield anti-rotation of torque levels to facilitate assembling and disassembling the heat shield assembly without damaging the heatshield. As such, the heatshield assembly facilitates preventing loss of retention during operation, and still allows non-destructive removal of heatshield at overhaul.

Exemplary embodiments of heat shield assemblies are described above in detail. The systems are not limited to the specific embodiments described herein, but rather, components of each assembly may be utilized independently and separately from other components described herein. Specifically, the above-described heat shield retention system is cost-effective and highly reliable, and may be utilized on a wide variety of combustors installed in a variety of gas turbine engine applications While the invention has been described in terms of various specific embodiments, those skilled in the art will recognize that the invention can be practiced with modification within the spirit and scope of the claims.

What is claimed is:

1. A method for fabricating a gas turbine engine combustor that includes a domeplate and at least one fuel injector extending through an opening in the domeplate, said method comprising:

fabricating a heatshield that includes a threaded collar extending upstream from the heatshield and a plurality of slots configured to receive a respective anti-rotation tab;

positioning the heatshield on a downstream side of the domeplate such that the threaded collar is received within the domeplate opening;

coupling a retainer to the collar on an upstream side of the domeplate such that the domeplate is securely coupled between the heat shield and the retainer fabricating a spacer that includes a plurality of anti-rotation tabs; and coupling the spacer between the retainer and the domeplate upstream side to the threaded coupling such that the anti-rotation tabs extend through the heatshield slots and at least partially into the heatshield to facilitate securely coupling the heat shield to the domeplate.

2. A method in accordance with claim 1 further comprising fabricating the spacer using a metallic material such that the spacer expands or contracts based on an operational temperature within the combustor.

3. A method in accordance with claim 1 further comprising:

forming a radial groove on the upstream side of the heat shield;

fabricating a spacer that includes a plurality of tabs extending radially inwardly from the spacer body; and coupling the spacer to the threaded coupling such that the plurality of radial tabs are substantially seated within the domeplate groove.

4. A method in accordance with claim 1 further comprising:

forming an opening that extends through a threaded interface between the collar and the retainer; and inserting a locking pin at least partially through the opening to facilitate securing the retainer to the collar.

5. A heat shield assembly for a gas turbine engine combustor, the combustor including a domeplate and at least one fuel injector extending through an opening in the domeplate, said heat shield assembly comprising:

a heat shield coupled against a downstream side of said domeplate;

a threaded collar extending upstream from said heatshield, said threaded collar received within said domeplate opening;

a retainer coupled to said collar such that said domeplate is securely coupled between said heat shield and said retainer;

a spacer coupled between said retainer and a domeplate upstream side, said spacer comprising a plurality of anti-rotation tabs, said anti-rotation tabs configured to extend through said domeplate and engage said heatshield to facilitate securely coupling said heat shield to said domeplate.

6. A heat shield assembly in accordance with claim 5 wherein said spacer is fabricated from a metallic material configured to expand or contract based on an operational temperature within said combustor.

7. A heat shield assembly in accordance with claim 5 wherein said domeplate comprises a groove formed in said domeplate upstream side, said spacer comprises a plurality of radial alignment tabs received within said groove to facilitate securely coupling said heat shield to said domeplate.

8. A heat shield assembly in accordance with claim 5 further comprising:

an opening extending through a threaded interface between said collar and said retainer; and a locking pin inserted at least partially through said opening to facilitate securing said retainer to said collar.

9. A heat shield assembly in accordance with claim 5 wherein said retainer comprises a castellated nut.

10. A gas turbine engine combustor comprising a combustion chamber comprising an inner liner and an outer liner, and a domeplate coupled to at least one of said inner and outer liners, said domeplate comprising a downstream side, an upstream side, and at least one opening extending therethrough for discharging cooling fluid therefrom for impingement cooling at least a portion of a heat shield assembly, said domeplate further comprises a groove formed in said domeplate upstream side, said heat shield assembly comprising:

a heat shield coupled against said domeplate downstream side;

a threaded collar extending upstream from said heatshield, said threaded collar received within said domeplate opening;

a retainer coupled to said collar such that said domeplate is securely coupled between said heat shield and said retainer; and a spacer coupled between said retainer and a domeplate upstream side, said spacer comprising a plurality of radial alignment tabs received within said groove to facilitate securely coupling said heat shield to said domeplate.

11. A gas turbine engine combustor in accordance wherein claim 10 wherein said spacer is fabricated from a metallic material configured to expand or contract based on an operational temperature within said combustor.

12. A gas turbine engine combustor in accordance with claim 10 wherein said spacer comprises a plurality of anti-rotation tabs, said anti-rotation tabs configured to extend through said domeplate and engage said heatshield to facilitate securely coupling said heat shield to said domeplate.

13. A gas turbine engine combustor in accordance with claim 10 further comprising:

an opening extending through a threaded interface between said collar and said retainer; and a locking pin inserted at least partially through said opening to facilitate securing said retainer to said collar.

14. A gas turbine engine combustor in accordance with claim 10 wherein said retainer comprises a castellated nut.

* * * * *

UNITED STATES PATENT AND TRADEMARK OFFICE

CERTIFICATE OF CORRECTION

PATENT NO. : 7,596,949 B2
APPLICATION NO. : 11/360205
DATED : October 6, 2009
INVENTOR(S) : DeVane et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 871 days.

Signed and Sealed this

Twenty-eighth Day of September, 2010

David J. Kappos

David J. Kappos
*Director of the United States Patent and Trademark Office*